US010336483B1

(12) United States Patent
Kumar

(10) Patent No.: US 10,336,483 B1
(45) Date of Patent: Jul. 2, 2019

(54) APPARATUS AND METHOD TO FORM A CUSHIONED PACKAGE HAVING AN INNER BAG WITHIN AN OUTER BAG

(71) Applicant: Amazon Technologies, Inc., Seattle, WA (US)

(72) Inventor: Pankaj Kumar, Canton, MI (US)

(73) Assignee: Amazon Technologies, Inc., Seattle, WA (US)

( * ) Notice: Subject to any disclaimer, the term of this patent is extended or adjusted under 35 U.S.C. 154(b) by 413 days.

(21) Appl. No.: 15/181,292

(22) Filed: Jun. 13, 2016

(51) Int. Cl.

| | |
|---|---|
| ***B65B 9/20*** | (2012.01) |
| ***B65B 39/00*** | (2006.01) |
| ***B65B 51/30*** | (2006.01) |
| ***B65B 61/06*** | (2006.01) |
| ***B65D 81/05*** | (2006.01) |

(52) U.S. Cl.
CPC ..... *B65B 9/2014* (2013.01); *B65B 39/007* (2013.01); *B65B 51/30* (2013.01); *B65B 61/06* (2013.01); *B65D 81/052* (2013.01)

(58) Field of Classification Search
CPC ..... B65D 81/02–81/022; B65D 81/025; B65D 81/027; B65D 81/03; B65D 81/09; B65D 81/3888; B65D 81/389; B65D 81/3895; B65D 81/3897; B65D 81/3272
USPC ..... 206/521–523; 33/105, 109–116
See application file for complete search history.

(56) References Cited

U.S. PATENT DOCUMENTS

| | | | |
|---|---|---|---|
| 2,657,158 | A | 10/1953 | Gerard |
| 3,340,669 | A | 9/1967 | Farquharson |
| 4,172,152 | A | 10/1979 | Carlisle |
| 4,854,736 | A | 8/1989 | McVeigh |
| 7,726,098 | B2 | 6/2010 | Doll |
| 2011/0299798 | A1 | 12/2011 | Coulson et al. |

OTHER PUBLICATIONS

Office action for U.S. Appl. No. 15/181,246 , dated Sep. 29, 2017, Kumar, "Cushioned Package Having an Inner Bag Within an Outer Bag", 18 pages.
Office action for U.S. Appl. No. 15/181,246 , dated Mar. 24, 2017, Kumar, "Cushioned Package Having an Inner Bag Within an Outer Bag", 17 pages.

*Primary Examiner* — Lori L Baker
(74) *Attorney, Agent, or Firm* — Lee & Hayes, P.C.

(57) ABSTRACT

A packaging device forms a cushioned package for securing and transporting fragile products, where the fragile products are secured within an inner bag that is coupled within a pressurized outer bag. In some embodiments, the inner bag and outer bag may be formed concurrently using an illustrative vertical form fill sealing device. The inner bag may include a first multi-layer material and the outer bag may include a second multi-layer material, each material having specific functional properties to protect the product contained within the package. During formation of the packaging, the first and second multi-layer materials may be sealed together, such as at ends of the package and/or along an edge seam created by an edge sealer. A width of the first multi-layer material may be less than a width of the second multi-layer material.

20 Claims, 11 Drawing Sheets

Section A-A

Section B-B

Section C-C

Section C-C

Section C-C

APPARATUS AND METHOD TO FORM A CUSHIONED PACKAGE HAVING AN INNER BAG WITHIN AN OUTER BAG

BACKGROUND

Items are often packaged in bags. Some bags include multiple layers that are adhered together to form a multi-layer material. The multiple layers are selected to perform specific tasks, such as to prevent oxygen from reaching items within the bag or to receive and maintain a printed graphic. In some instances, packaging devices are used to form a bag immediately prior to placing product into the newly-formed bag, or partially formed bag, which is then sealed to secure the items within the bag.

Some breakable items are packaged in bags, such as potato chips, pretzels, and other food items. These bags fail to prevent breakage of the items contained within the bags. To reduce breakage of items, the bags are often shipped in boxes containing other bags with similar contents or having contents with similar weight, using dividers, and/or employing other expensive or time consuming techniques. However, if the bags are shipped with significantly heavier items, such as a book, the contents of the bags may be destroyed or at least broken into many smaller pieces as a result of the book moving within a box during transit since the bags do little or nothing to prevent breakage of the items contained within the bags.

BRIEF DESCRIPTION OF THE DRAWINGS

The detailed description is described with reference to the accompanying figures. In the figures, the left-most digit(s) of a reference number identifies the figure in which the reference number first appears. The same reference numbers in different figures indicate similar or identical items.

FIG. 2 also shows a detail of the layers that form the inner bag and the outer bag.

DETAILED DESCRIPTION

Figure 1:
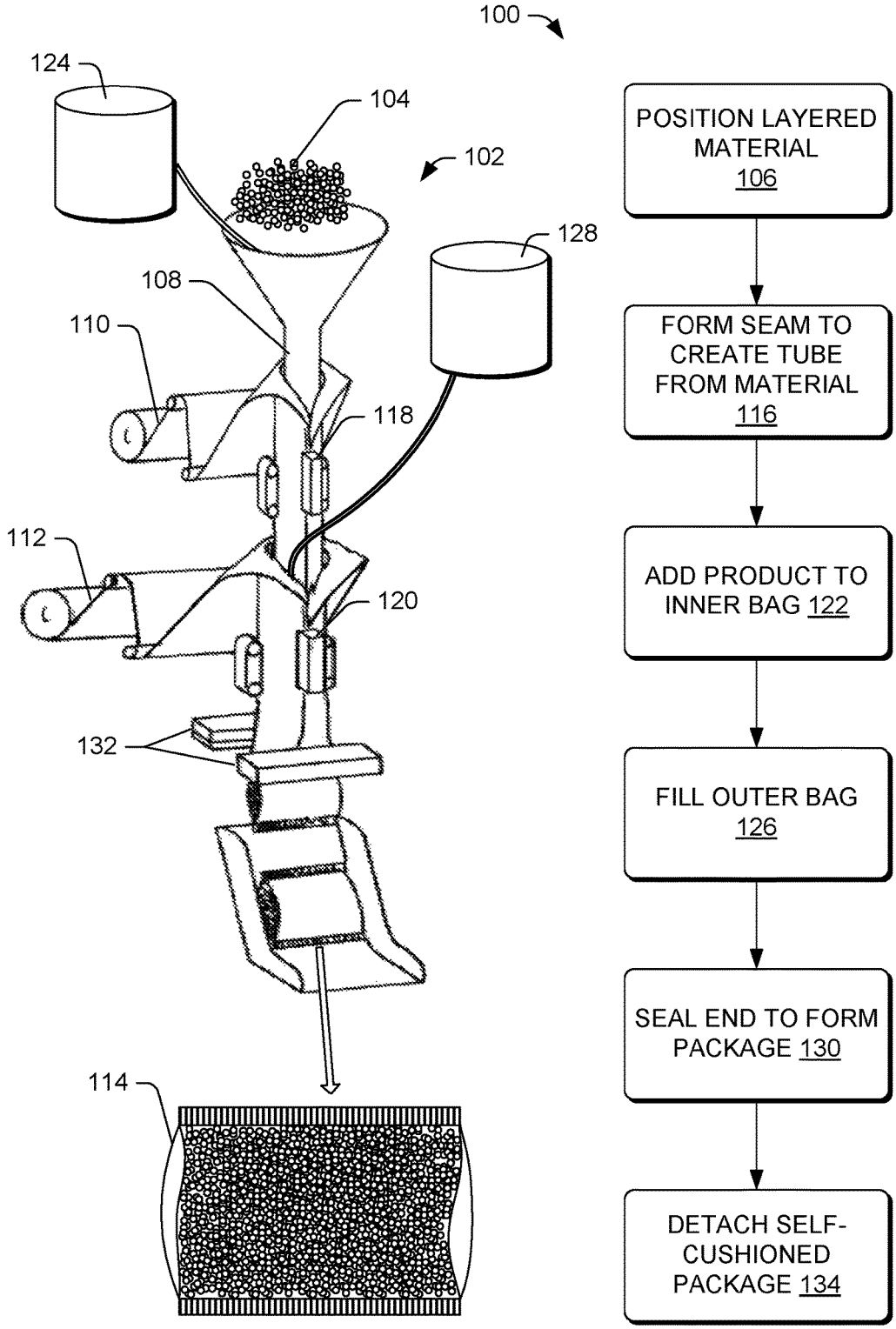
FIG. 1 is a pictorial flow diagram of an illustrative process of creating a cushioned package using an illustrative packaging device that forms an inner bag to secure a product where the inner bag is formed within an outer bag.

This disclosure is directed to a packaging device and techniques to form a cushioned package for securing and transporting fragile products, where the fragile products are secured within an inner bag that is coupled within an outer bag. In some embodiments, the inner bag and outer bag may be formed concurrently using an illustrative vertical form fill sealing device, referred to herein as a packaging device. The inner bag may include a first multi-layer material that has specific properties to protect the product contained within the inner bag. The layers may include an oxygen inhibiting layer (e.g., an aluminum foil layer, etc.), an adhesive layer, and a low-density polyethylene (LDPE) layer. The outer bag may include a second multi-layer material having specific properties. The layers may include a polyethylene terephthalate (PET) layer that can accept a printable graphic, an adhesive layer, and a LDPE layer. During formation of the packaging, the first and second multi-layer materials may be sealed together, such as at ends of the package and/or along an edge seam created by an edge sealer. A width of the first multi-layer material may be less than a width of the second multi-layer material, such that the inner bag formed within the outer bag has a smaller volume than the outer bag.

The outer bag may be filled with a cushioning substance that is not included inside the inner bag. The cushioning substance may be pressurized gas (including air), foam, paper, and/or other substances that cushion the inner bag. For example, when a lateral force is applied to the outer bag, the cushioning substance may at least partly absorb and/or at least partly distribute the lateral force away from the product in the inner bag to protect the product from damage.

The packaging device may include a hopper that stores product and selectively dispenses product into packaging. The hopper may be coupled to a filling tube, which directs the product into an inner bag. Meanwhile, the filling tube may be at least partially surrounded by the first and second multi-layer material, which may be drawn from spools and directed about the filling tube by material guides. The first and second multi-layer material may be sealed by an edge sealer to adjoin opposing sides of the material to form a tube-shape of material around the filling tube. The product may be dispensed within the inner bag. In some instances, oxygen may be removed from the inner bag, such as when the product is food. Air or other substances may be injected or dispensed within the outer bag to create a cushion to protect the inner bag having the product, which is contained within the outer bag. The inner bag prevents the air or other substances from mixing with the product. The outer bag may be pressurized to create a gap or space between walls of the outer bag and walls of the inner bag. Sealing jaws may create a seam across the inner and outer bag to seal the product in the inner bag and to seal the air or other substances in the outer bag. A cutting blade may separate the cushioned package from the first and second multi-layer material fed from the spools. The resulting cushioned package containing the product may be ready for shipment.

In some embodiments, the packaging device may include clamps that inhibit loss of air or other substances from the outer bag prior to sealing the outer bag with the sealing jaws. The outer bag may be formed of an elastic material that accommodates at least some deformation.

The techniques and apparatuses described herein may be implemented in a number of ways. Example implementations are provided below with reference to the following figures.

FIG. 1 is a pictorial flow diagram of an illustrative process 100 of creating a cushioned package using an illustrative packaging device 102 that forms an inner bag to secure a product 104 where the inner bag is formed within an outer bag. The inner bag and outer bag form a package, which may be shipped to a user or otherwise used to safely transport the product while minimizing or reducing damage to the product during transport (e.g., via transport by a common carrier, transport in a shopping cart or in a trunk of a car, etc.).

At 106, the packaging device 102 may include a filling tube 108 which is used in part to position first multi-layered material 110 and second multi-layered material 112 prior to sealing opposite sides of the materials to create a body of a package 114. In some embodiments, the filling tube 108 may include a forming collar to guide the material 110, 112 around or about the filling tube 108. The filling tube 108, via an interior cavity, may also be used to transport the product 104 into an inner bag formed by at least some of the first material 110. The material 110 and 112 may be drawn from spools. The material 110 may include different layers than the material 112. For example, the first material 110 may be used to form an inner bag used to secure the product 104 while the second material 112 may be used to form a pressurized outer bag used to protect the product 104 by operating as an air cushion.

At 116, a first edge sealer 118 may create an edge seam (e.g., a vertical seam) that joins opposing sides of the first material 110 together to form a tube for the inner bag. A second edge sealer 120 may create an edge seam that joins opposing sides of the second material 112 together to form a tube for the outer bag. In various embodiments, a single edge sealer may be used to form the edge seam for both the first material 110 and the second material 112, which may join the inner bag and outer bag at this edge seam.

At 122, the product 104 may be added to the inner bag to fill at least a portion of the inner bag. The product 104 may be inserted into an aperture of a first end of the filling tube 108 and enter the inner bag from a second end of the filling tube 108. In some embodiments, oxygen may be removed from the inner bag to preserve food products, such as by dispensing nitrogen gas into the filling tube via a first dispenser 124.

At 126, the outer bag may be filled with air, a gas, and/or a substance, which creates a cushion to protect the inner bag and the product 104 secured within the inner bag. A second dispenser 128 may dispense the air, the gas, and/or the substance into the outer bag, while refraining from filling the inner bag with the air, the gas, and/or the substance. In some embodiments, the outer bag may be pressurized by the air and/or the gas.

At 130, sealing jaws 132 may create a seam across a portion of the materials 110 and 112 the form the inner bag and the outer bag. This seam may enclose the air, the gas, and/or the substance within the outer bag and enclose the product 104 within the inner bag. The seam may couple at least a portion of the inner bag to the outer bag.

At 134, the package 114 may be detached, such as by a cutting action from a cutting blade, from the first material 110 and the second material 112. The package 114 may be an self-cushioned package that includes a cushion layer formed of air, gas, and/or a substance situated between the outer bag and the inner bag, and used to protect the product 104 secured within the inner bag.

Figure 2:
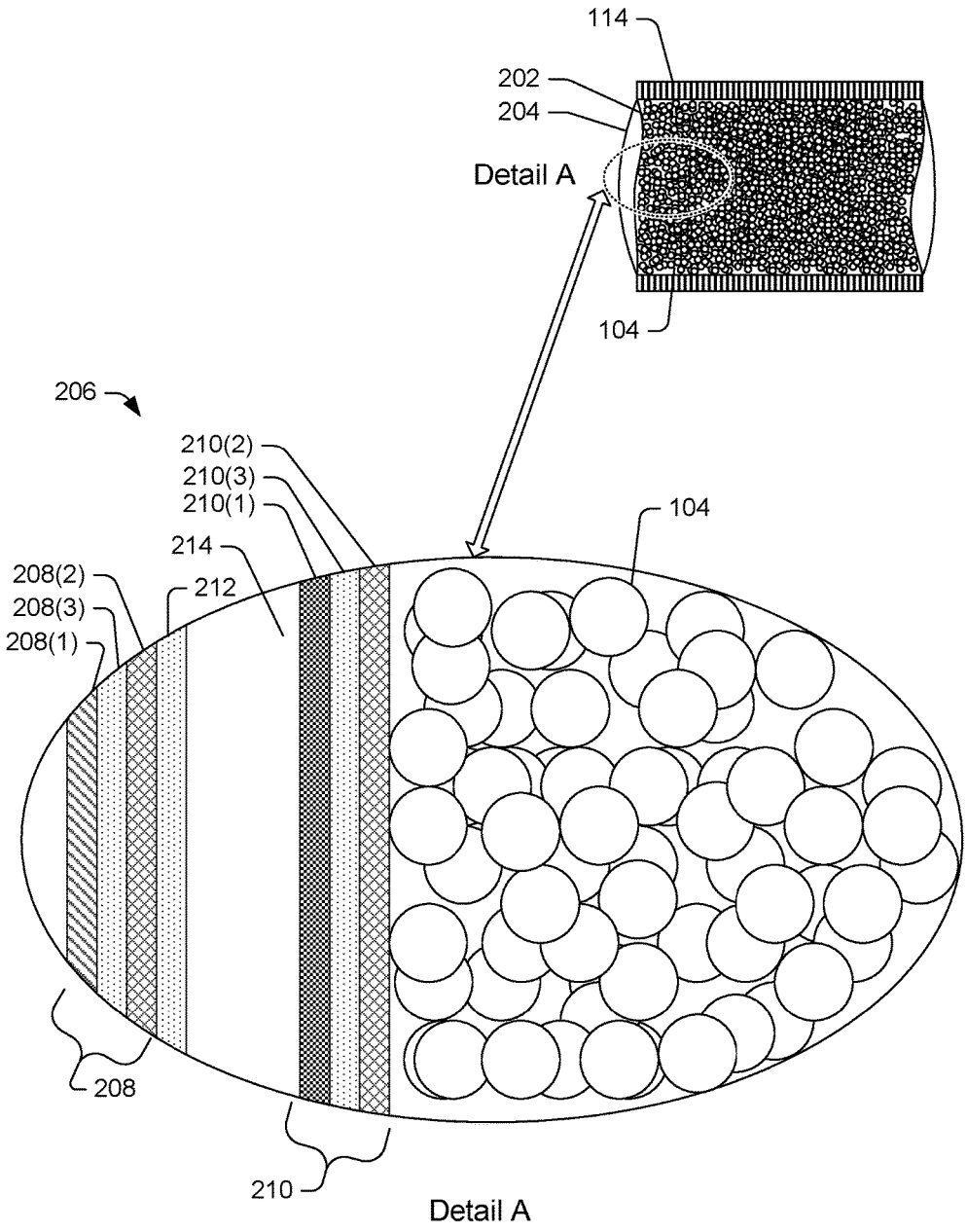
FIG. 2 is a perspective view of an illustrative package that includes product secured within an inner bag, where the inner bag is located within an outer bag.

FIG. 2 is a perspective view of the illustrative package 114 that includes the product 104. The product is secured within an inner bag 202. The inner bag 202 is located within an outer bag 204, which may be pressurized or otherwise include properties that create a cushion to protect the product 104 located within the inner bag 202.

Detail A shows a portion of the package 114 to further show illustrative layers 206 that form the inner bag 202 and the outer bag 204. A first multi-layer material 208 may include at least two layers joined by an adhesive, such as glue. A second multi-layer material 210 may include at least another two layers, which may also be joined by an adhesive.

In some embodiments, the first multi-layer material 208 may include a first layer 208(1), which may be a polyethylene terephthalate (PET) layer or other printable layer. However, the layer 208 (1) may be formed of an elastic material, which may enable the outer bag to deform shape in response to a lateral force applied against the outer bag. The first multi-layer material 208 may include a second layer 208(2), which may be a low-density polyethylene (LDPE) layer that facilitates creation of a seam to close the outer bag 204, such as at the end of the package and/or along an edge seam, via the seam sealer. The first layer 208(1) and the second layer 208(2) may be adjoined by an adhesive layer 208(3).

In some embodiments, the second multi-layer material 210 may include a first layer 210(1), which may be a metallic layer, such as aluminum foil. However, the layer 210(1) may be formed of other materials that protect the product 104 from oxygen or from other substances or gases. The second multi-layer material 210 may include a second layer 210(2), which may be an LDPE layer that facilitates creation of a seam to close the outer bag 204, such as at the end of the package and/or along a vertical side seam, via the seam sealer. The first layer 210(1) and the second layer 210(2) may be adjoined by an adhesive layer 210(3).

An additional adhesive layer 212 may be added adjacent to the second layer 208(2) or adjacent to the first layer 210(1), which may be used to seal the first multi-layer material 208 to second multi-layer material 210, such as when creating the seam by the sealing jaws or the seam sealer, as discussed above. In spaces or gaps where the first multi-layer material 208 is separated from the second multi-layer material 210, a space 214 (or gap) may be filled with air, a gas, and/or another substance that creates a cushion to protect the inner bag 202 from lateral forces exerted against the outer bag 204. As an example, the space 214 may be filled with low density foam in some embodiments, where the foam creates a cushion to protect the inner bag 202 and the product 104.

The layers of the material(s) may include a plurality of layers that include inner layers that are at least partially separated from outer layers. The inner layers may form an inner cavity to secure a product. The outer layers may be coupled to the inner layers with a shared seam along at least one edge of the multi-layer bag. A cushioning substance may be situated between the inner layers and the outer layers to offset at least a first portion of the inner layers from at least a second portion of the outer layers.

Figure 3A:
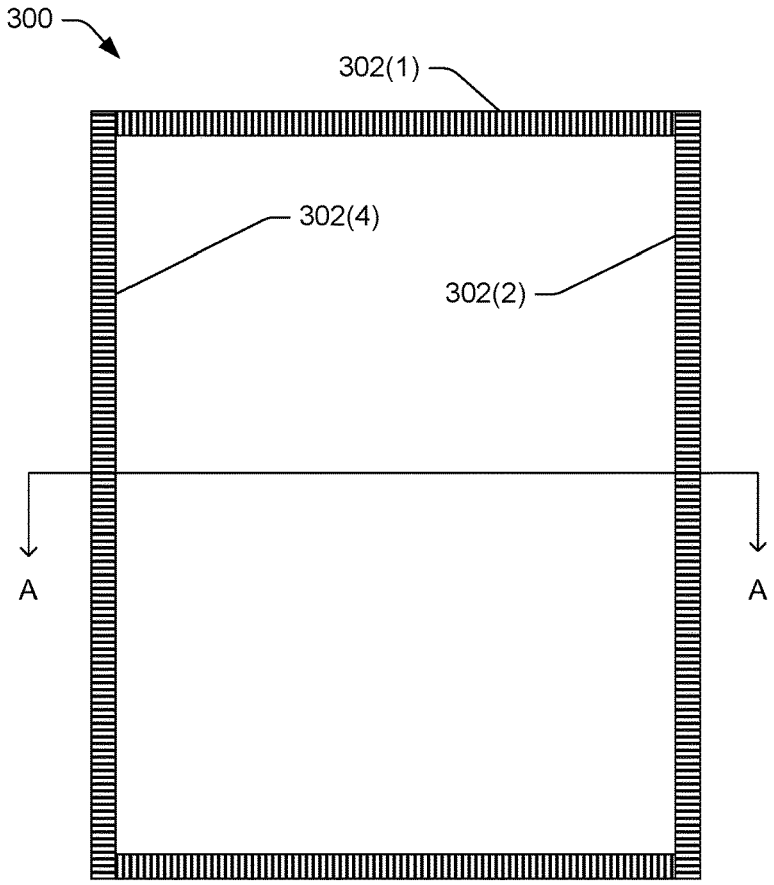
FIGS. 3A, 3C, and 3E are top elevation views of illustrative different packages where an inner bag is formed within an outer bag.
Figure 3B:
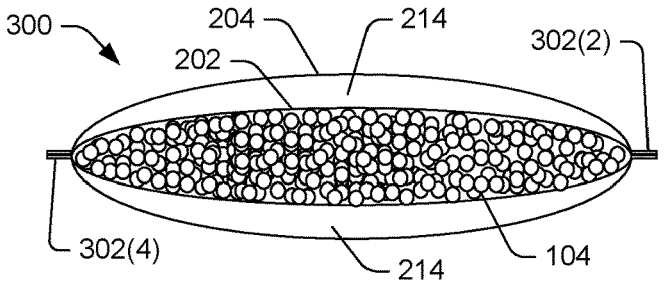
FIGS. 3B, 3D, and 3F are side elevation views of cross-sectional views taken from FIGS. 3A, 3C, and 3E, respectively, which show locations of the inner bag within the outer bag.
Figure 3C:
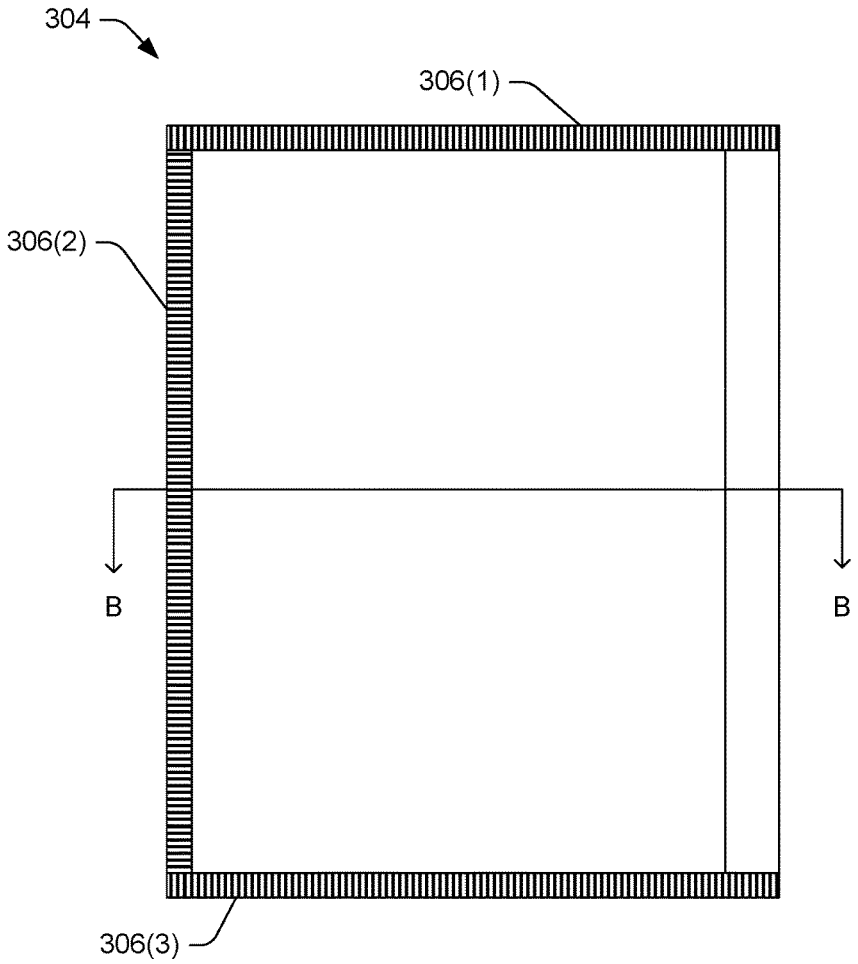
Figure 3D:
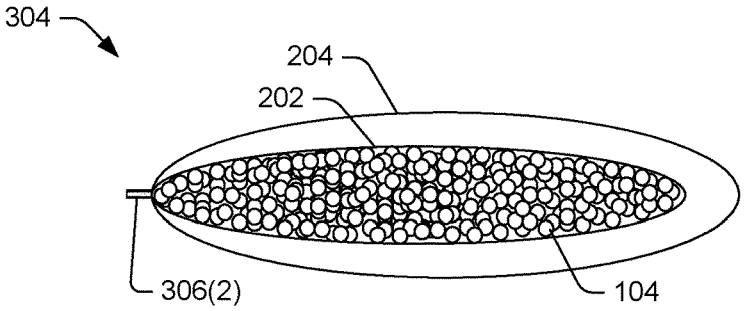
Figure 3E:
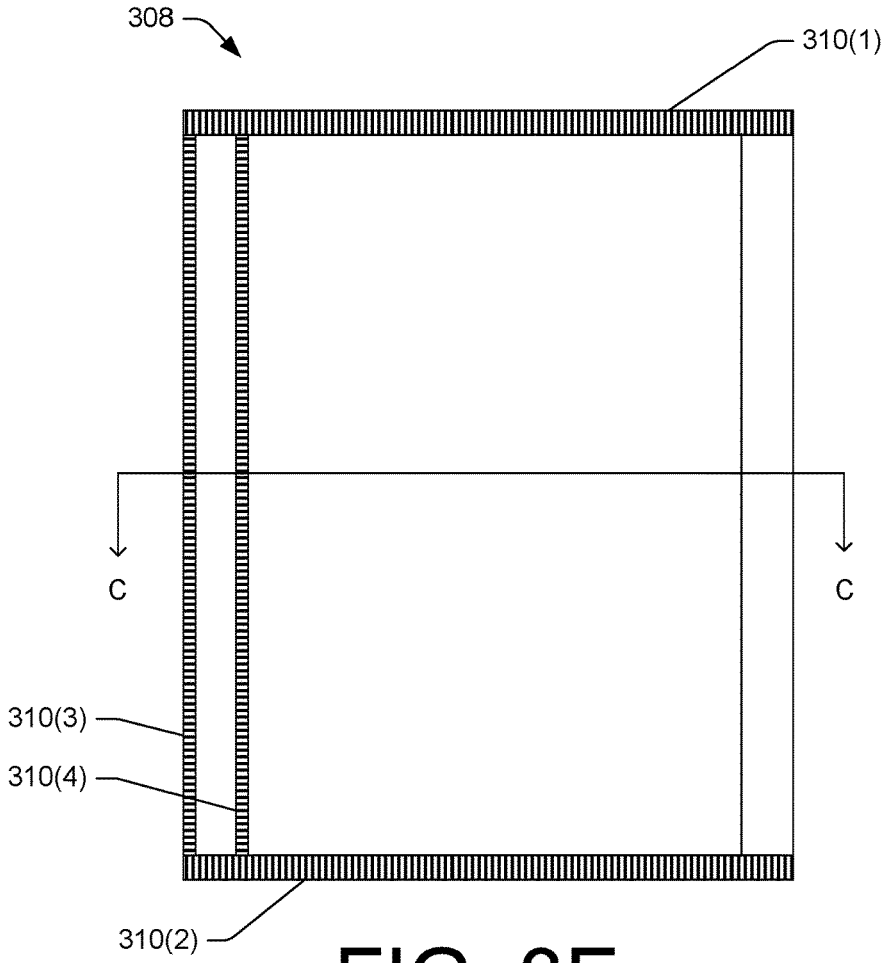
Figure 3F:
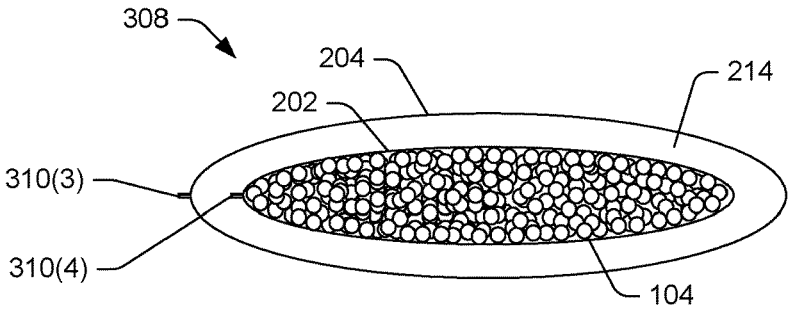

FIGS. 3A-3F show details of the locations of the space 214 in different configurations of the package. FIGS. 3A, 3C, and 3E are top elevation views of illustrative different packages where an inner bag is formed within an outer bag. FIGS. 3B, 3D, and 3F are side elevation views of cross-sectional views taken from FIGS. 3A, 3C, and 3E, respectively, which show locations of the inner bag within the pressurized outer bag.

FIG. 3A shows a first package 300 that may include the inner bag coupled to the outer bag along four different seams, 302(1)-(4). The seams 302(1) and 302(3) may be formed by the sealing jaws. The seams 302(2) and 302(4) may be edge seams formed by different edge sealers. Thus, the package 300 may be formed by a four-seam packaging device, such as the device shown in FIG. 7. FIG. 3B shows a cross-sectional view of the package 300 along Section A-A. As shown, the package 300 includes the space 214 on either side between the inner bag 202 and the outer bag 204. The inner bag 202 and the outer bag are coupled by the seams 302(2) and 302(4), as shown in the cross-sectional view. Of course, the inner bag 202 and the outer bag 204 are also coupled by the seams 302(1) and 302(3), which are not shown in the cross-sectional view. The inner bag 202 is filled with, and secures, the product 104. The outer bag 204 includes the inner bag 202 and includes the space 214, which may be pressurized, and filled with air, a gas, and/or a substance (e.g., foam, etc.).

FIG. 3C shows a second package 304 that may include the inner bag coupled to the outer bag along three different seams, 306(1)-(3). The seams 306(1) and 306(3) may be formed by the sealing jaws. The seam 306(2) may be an edge seam formed by an edge sealer. Thus, the package 304 may be formed by a three-seam packaging device, such as the device shown in FIG. 5 or possibly by a four-seam packaging device, such as the device shown in FIG. 6. FIG. 3D shows a cross-sectional view of the package 304 along Section B-B. As shown, the package 304 includes the space 214 on either side between the inner bag 202 and the outer bag 204. The inner bag 202 and the outer bag 204 are coupled by the seam 306(2), as shown in the cross-sectional view. Of course, the inner bag 202 and the outer bag are also coupled by the seams 306(1) and 306(3), which are not shown in the cross-sectional view. The inner bag 202 is filled with, and secures, the product 104. The outer bag 204 includes the inner bag 202 and includes the space 214, which may be pressurized, and filled with air, a gas, and/or a substance (e.g., foam, etc.).

FIG. 3E shows a third package 308 that may include the inner bag coupled to the outer bag along two different seams, 310(1) and 310(2). The seams 310(1) and 306(2) may be formed by the sealing jaws. Single bag seams 310(3) and 310(4) may seal sides of the outer bag and inner bag, respectively. Thus, the package 308 may be formed by a three-seam packaging device, such as the device shown in FIG. 4 or possibly by a four-seam packaging device, such as the device shown in FIG. 6, when additional single bag seams are present (e.g., a total of four single bag seams). FIG. 3F shows a cross-sectional view of the package 308 along Section C-C. The inner bag 202 and the outer bag 204 are also coupled by the seams 310(1) and 310(2), which are not shown in the cross-sectional view. As shown, the package 308 includes the space 214 between the inner bag 202 and the outer bag 204. The inner bag 202 is filled with, and secures, the product 104. The outer bag 204 includes the inner bag 202 and includes the space 214, which may be pressurized, and filled with air, a gas, and/or a substance (e.g., foam, etc.).

Figure 3G:
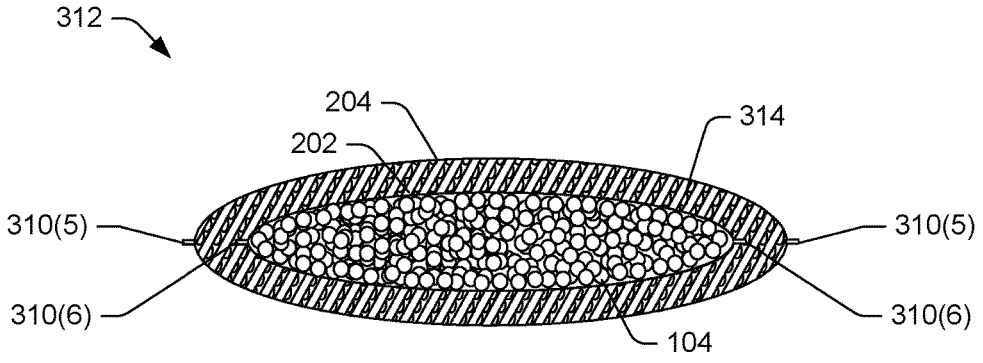
FIGS. 3G and 3H are side elevation views of cross-sectional views taken from FIG. 3E, which show illustrative fill substances positioned between the inner bag and the outer bag.
Figure 3H:
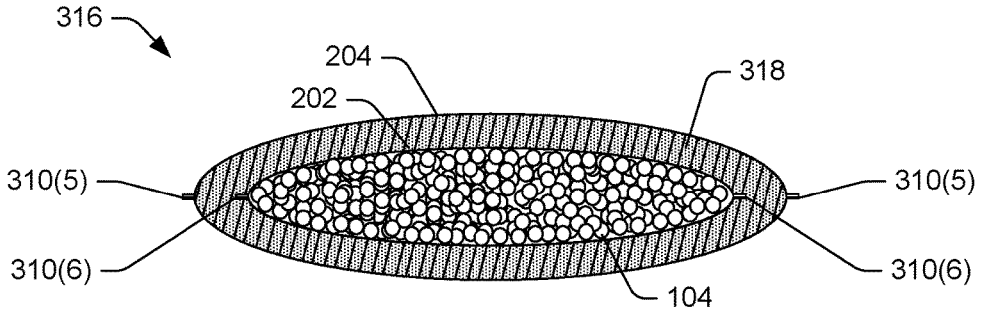

FIGS. 3G and 3H are side elevation views of cross-sectional views taken from FIG. 3E, which show illustrative fill substances placed between the inner bag and the outer bag. FIG. 3G shows an illustrative package 312 that includes a fill substance 314. The fill substance 314 may be paper, such as crumpled paper, folded paper, or other paper-based fill (including cardboard and other paper-based products). The fill substance 314 may not be coupled to the inner bag 202, the outer bag 204, or both. The fill substance 314 may be injected into the outer bag 204 via the second dispenser 128 or otherwise placed into the outer bag 204, while not being placed in the inner bag 202. The paper may form a cushion to protect the product 104 in the inner bag 202. For example, when a lateral force is applied to the outer bag, the paper may at least partly absorb and/or at least partly distribute the lateral force away from the product 104 in the inner bag 202.

FIG. 3H shows an illustrative package 316 that includes a fill substance 318. The fill substance 318 may be foam, such as foam particles, a foam layer, or both. The fill substance 318 may not be coupled to the inner bag 202, the outer bag 204, or both. The fill substance 318 may be injected into the outer bag 204 via the second dispenser 128 or otherwise placed into the outer bag 204, while not being placed in the inner bag 202. For example, the foam may be injected into the outer bag in liquid form, and may at least partially solidify to create a cushion. Lose particles of foam may be inserted into the outer bag. The foam may form a cushion to protect the product 104 in the inner bag 202. For example, when a lateral force is applied to the outer bag, the foam may at least partly absorb and/or at least partly distribute the lateral force away from the product 104 in the inner bag 202.

Figure 4:
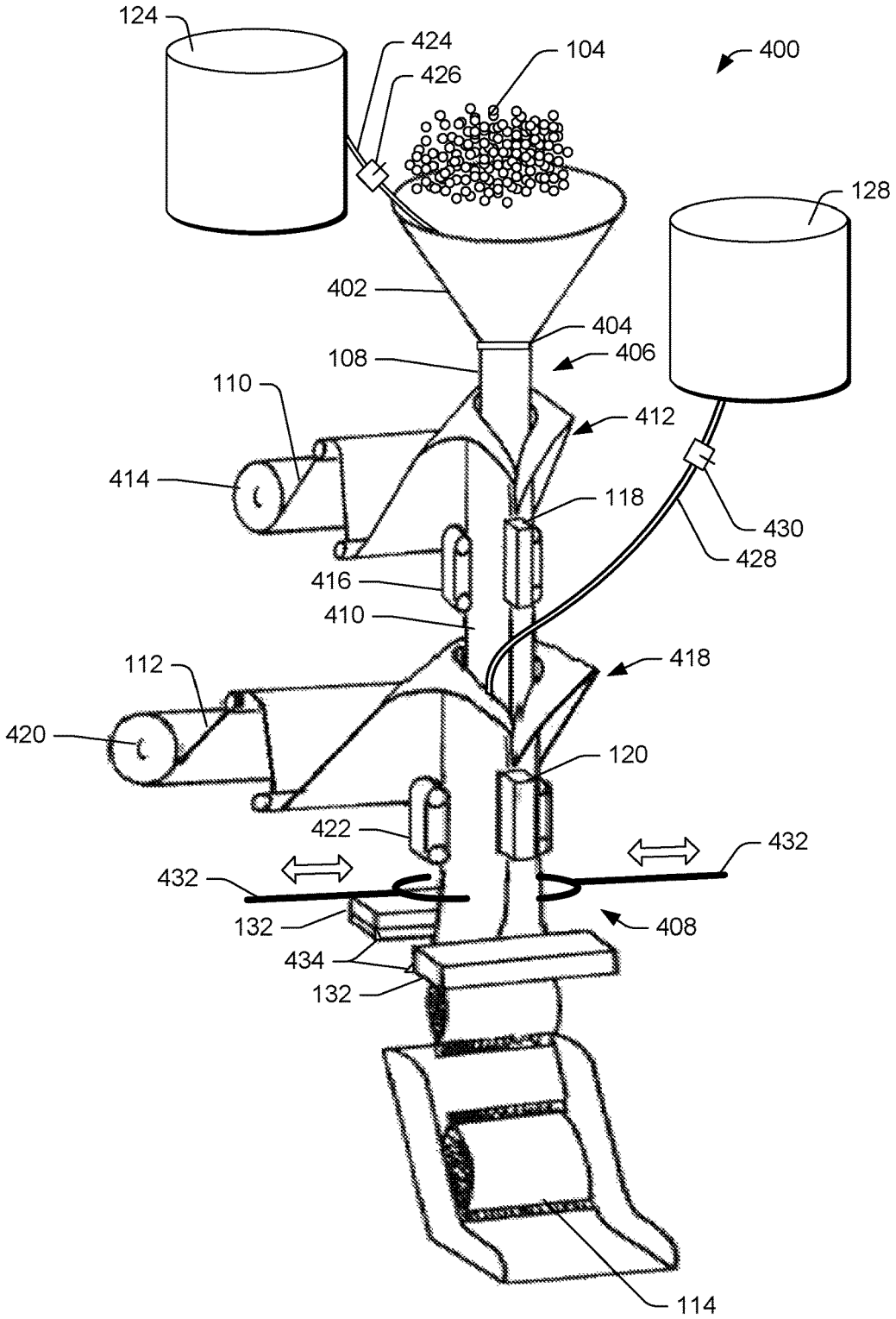
FIG. 4 is a perspective view of an illustrative three-seam packaging device that seals at least one seam of the inner bag independent of at least one seam of the outer bag.

FIG. 4 is a perspective view of an illustrative three-seam packaging device 400 that seals at least one seam of the inner bag independent of at least one seam of the outer bag. As discussed above, the packaging device 400 may be used to create the package 308 shown in FIGS. 3E and 3F, for example.

The packaging device 400 may include a hopper 402 to store the product 104. The hopper 402 may be located above the filling tube 108 to enable gravity to move the product from the hopper 402 into inner bag via the filling tube 108. In some embodiments, the hopper 402 may store enough product to fill many packages. In various embodiments, the hopper 402 may be a funnel or other shape that collects product delivered by a conveyer belt or other product transport mechanisms.

A dispensing device 404 may be located between the hopper 402 and the filling tube 108 to selectively open and allow a predetermined amount of product to enter the filling tube 108. The dispensing device 404 may be configured to measure or limit an amount of product released through the valve during a predetermined time period or release.

The filling tube 108 may include a first end 406 coupled to the hopper 402, the dispensing device 404, or a conduit coupled to the same. The filling tube 108 may include a second end 408 that is located proximate the sealing jaws 132. The filling tube 108 may include a body 410 having a profile to guide the material toward the sealing jaws 132.

As shown in FIG. 4, a first forming collar 412 may be located between the first end 406 of the filling tube 108 and the first edge sealer 118. The first forming collar 412 may guide the first material 110 from a spool 414 about and/or around the body 410 of the filling tube 108 in preparation for opposing sides of the first material 110 being mated by the first edge sealer 118. One or more driving belts 416, or similar mechanisms (e.g., mandrels), may position the material adjacent to the body 410 of the filling tube 108 and/or may move the first material 110 at times toward the sealing jaws 132. The sealing jaws 132 may also move the material, such as by pulling the material in a direction away from the hopper 402.

In various embodiments, a second forming collar 418 may be located between the first end 406 of the filling tube 108 and the second edge sealer 120. The second forming collar 418 may guide the second material 112 from a spool 420 about and/or around the body 410 of the filling tube 108 in preparation for opposing sides of the second material 112 being mated by the second edge sealer 118. One or more driving belts 422, or similar mechanisms (e.g., mandrels), may position the material adjacent to the body 410 of the filling tube 108 and/or may move the second material 112 at times toward the sealing jaws 132. In some embodiments, idlers may also be used to maintain a location of the first material 110 and/or the second material 112 proximate to the filling tube 108.

The first dispenser 124 may store nitrogen gas or another gas or substance, which may be used to flush (remove) oxygen from the inner bag. For example, when the product 104 is a food product, it may be desirable to remove oxygen from the inner bag to help preserve the food product for a longer duration of time. The first dispenser 124 may include a first tube 424 (or conduit) that directs the nitrogen or other gas or substance from the first dispenser 124 to the inner bag. The first tube 424 may include a first valve 426 to regulate flow of the nitrogen or other gas or substance from the first dispenser 124 to the inner bag.

The second dispenser 128 may store air, a gas or a substance, which may be added to the outer bag to create a cushion to protect the product secured within the inner bag. For example, air may be added to the outer bag to pressurize the outer bag and may refrain from pressurizing the inner bag. As another example, foam may be added to the outer bag to create a cushion. The second dispenser 128 may include a second tube 428 (or conduit) that directs the air, the gas or the substance from the second dispenser 128 to the outer bag, such as via an opening between the first material 110 and the second material 112 below the second forming collar 418. The second tube 428 may include a second valve 430 to regulate flow of the air, the gas, or the substance from the second dispenser 128 to the outer bag.

In some embodiments, the packaging device 400 may include clamp arms 432 that, when in a closed position, can hinder air or gas from escaping the outer bag, such as to enable pressurizing the outer bag. The closed position may be defined as when the clamp arms 432 engage the second material 112 against the body 410 of the filling tube 108 near the second end 408. The clamping arms may be actuated to the closed position during or after filling the outer bag with air or gas. Next, the sealing jaws 132 may create a seam to secure and maintain the pressure in the outer bag. The clamping arms 432 may then be moved to an open position where the clamping arms disengage from the second material 112 and from the filling tube 108.

Cutting blades 434 may be used to separate the package 114 from the first material 110 and the second material 112 fed from the spools, and thereby release the finished packaging that contains the product within the inner bag and includes a cushioning outer bag that contains the inner bag.

Figure 5:
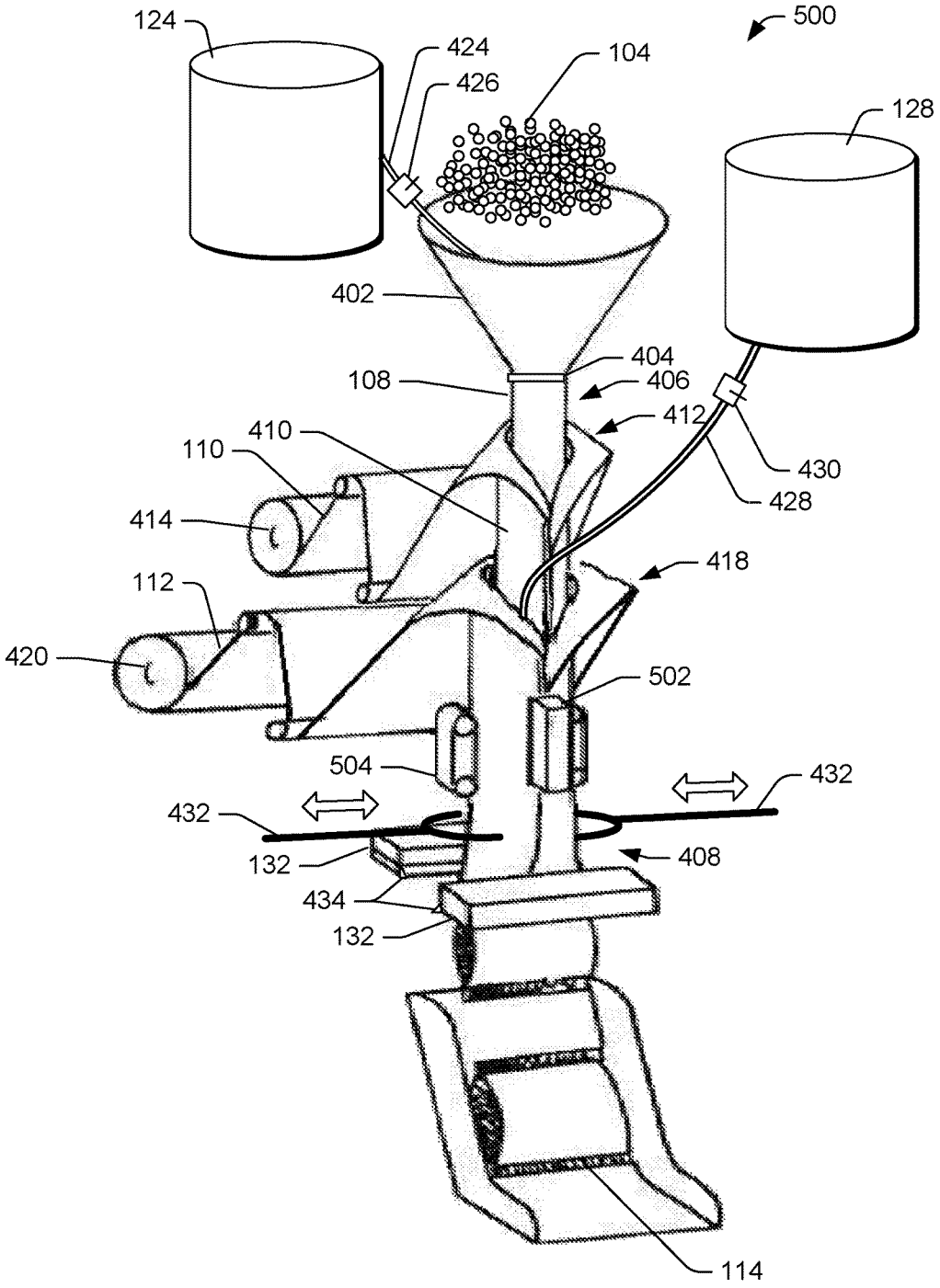
FIG. 5 is a perspective view of an illustrative three-seam packaging device that concurrently seals an edge seam of the inner bag and the outer bag.

FIG. 5 is a perspective view of an illustrative three-seam packaging device 500 that concurrently seals a longitudinal seam of the inner bag and the outer bag. As discussed above, the packaging device 500 may be used to create the package 304 shown in FIGS. 3C and 3D, for example.

Unlike the packaging device 400, the packaging device 500 may include a single edge sealer 502, which may seal both the first material 110 and the second material 112 together in a common seam and create a two-walled material tube. The outer wall may define the outer bag while the inner wall may define the inner bag. One or more driving belts 504, or similar mechanisms (e.g., mandrels), may position the first and second material 110, 112 adjacent to the body 410 of the filling tube 108 and/or may move the first and second material 110, 112 at times toward the sealing jaws 132. In some embodiments, idlers may also be used to maintain a location of the first material 110 and/or the second material 112 proximate to the filling tube 108. Otherwise, the components of the packaging device 500 may be the same or similar to the components of the packaging device 400, and may operate in the same or similar manner as described above.

Figure 6:
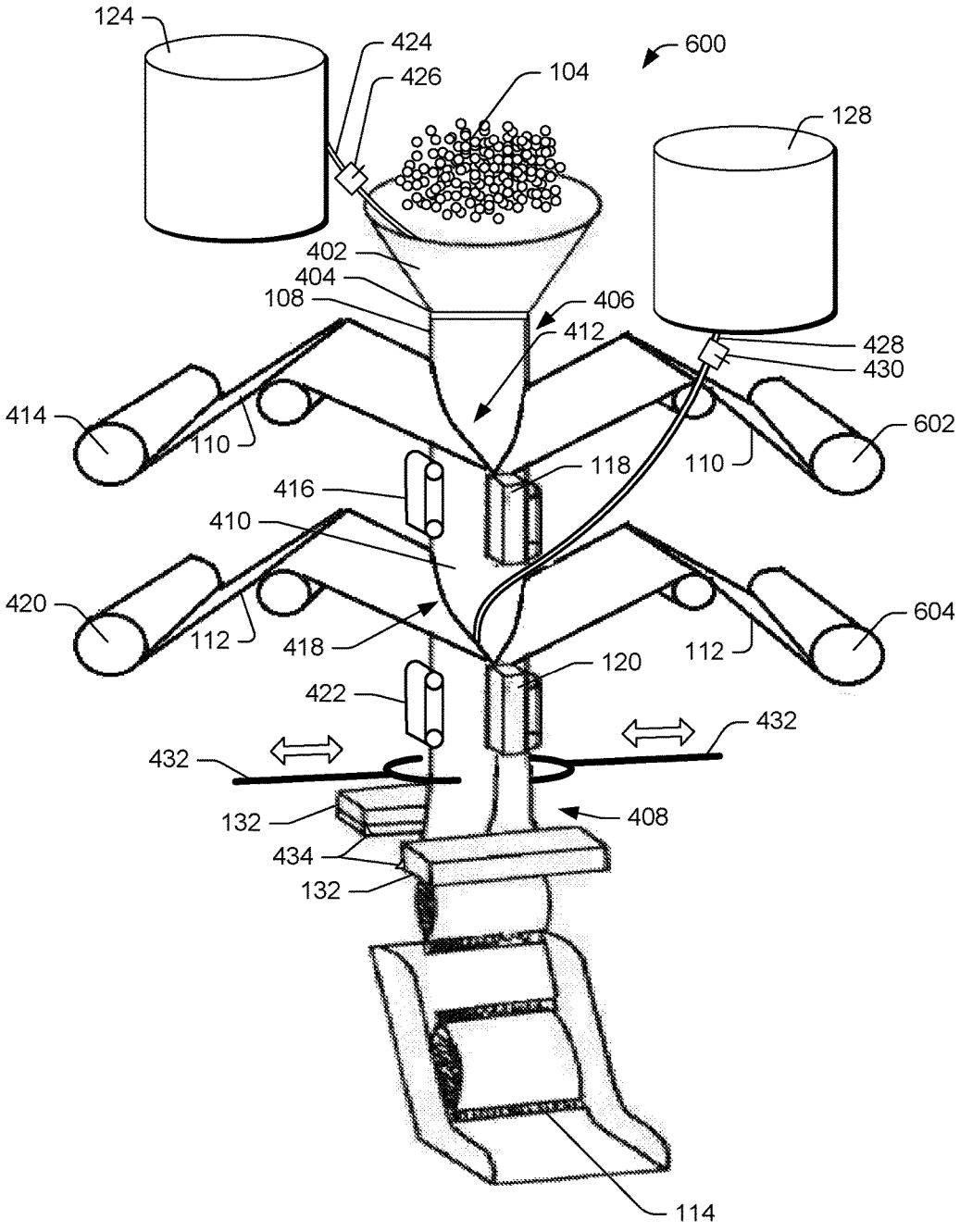
FIG. 6 is a perspective view of an illustrative four-seam packaging device that seals at least one seam of the inner bag independent of at least one seam of the outer bag.

FIG. 6 is a perspective view of an illustrative four-seam packaging device 600 that seals at least one seam of the inner bag independent of at least one seam of the outer bag. As discussed above, the packaging device 600 may be used to create the package 304 shown in FIGS. 3C and 3D and/or the package 308 shown in FIGS. 3E and 3F, for example.

Unlike the packaging device 400 and the packaging device 500, the packaging device 600 may include an additional roll of the first material 110 on a third spool 602 and an additional roll of the second material 112 on a forth spool 604. The packaging device 600 may use two of the edge sealers 118 to create a tube of the first material 110 by joining edges of the different rolls of the first material 110. Similarly, the packaging device 600 may use two of the edge sealers 120 to create a tube of the second material 112 by joining edges of the different rolls of the second material 112. Otherwise, the components of the packaging device 600 may be the same or similar to the components of the packaging device 400 and 500, and may operate in the same or similar manner as described above.

Figure 7:
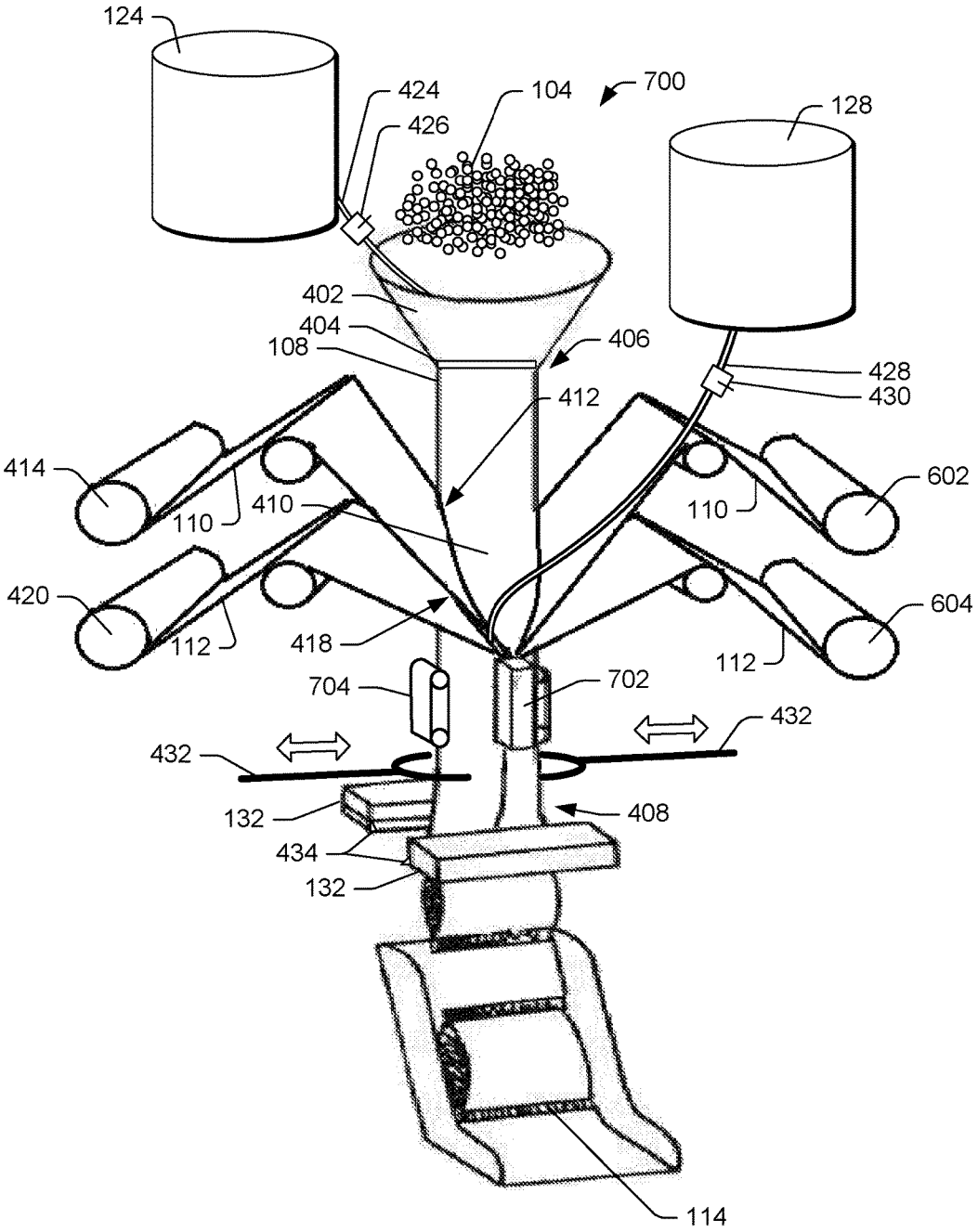
FIG. 7 is a perspective view of an illustrative four-seam packaging device that concurrently seals at least one edge seam of the inner bag and the outer bag.

FIG. 7 is a perspective view of an illustrative four-seam packaging device 700 that concurrently seals at least one longitudinal seam of the inner bag and the outer bag. As discussed above, the packaging device 700 may be used to create the package 300 shown in FIGS. 3A and 3B, for example.

Unlike the packaging device 600, the packaging device 700 may include a single pair of edge sealers 702, which may seal both the first material 110 and the second material 112 together in a common seam and create a two-walled material tube. The outer wall may define the outer bag while the inner wall may define the inner bag. One or more driving belts 704, or similar mechanisms (e.g., mandrels), may position the first and second material 110, 112 adjacent to the body 410 of the filling tube 108 and/or may move the first and second material 110, 112 at times toward the sealing jaws 132. In some embodiments, idlers may also be used to maintain a location of the first material 110 and/or the second material 112 proximate to the filling tube 108. Otherwise, the components of the packaging device 700 may be the same or similar to the components of the packaging device 400, 500, and 600, and may operate in the same or similar manner as described above.

Figure 8:
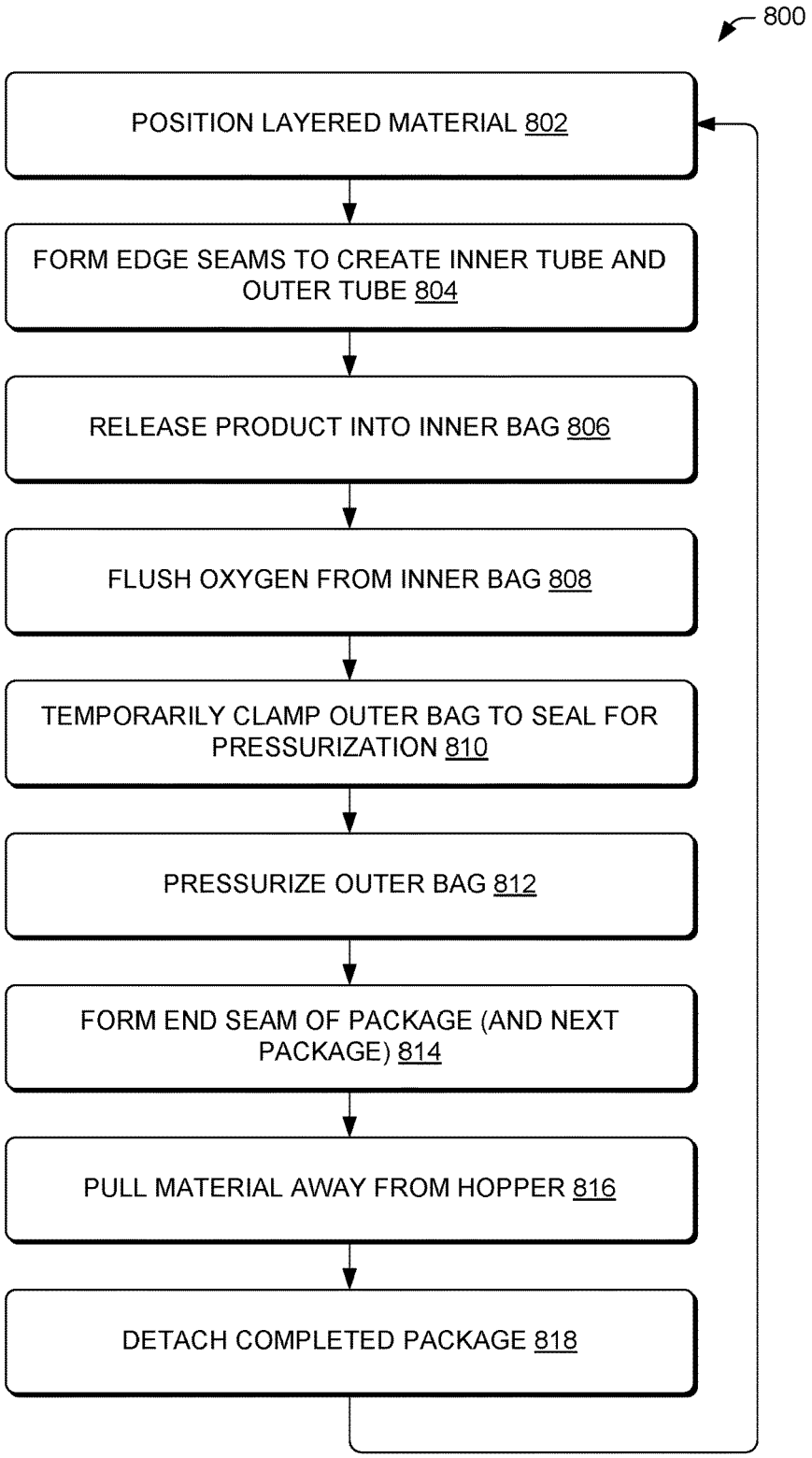
FIG. 8 is a flow diagram of an illustrative process to form a cushioned package having an inner bag within a pressurized outer bag.

FIG. 8 is a flow diagram of an illustrative process 800 to form a cushioned package having an inner bag within a pressurized outer bag. The process 800 is illustrated as a collection of blocks in a logical flow graph, which represent a sequence of operations that can be implemented at least partly by the packaging device described herein. The order in which the operations are described is not intended to be construed as a limitation, and any number of the described blocks can be combined in any order and/or in parallel to implement the process. The process 800 may be performed by any of the packaging devices 400, 500, 600, and/or 700 described above.

At 802, the packaging device may position layered material about the filling tube. The material may include the first material and the second material, each including multiple layers as discussed above with reference to FIG. 2. In some embodiments, the same material may be drawn from multiple spools, such as shown with reference to FIGS. 6 and 7. Forming collars and/or other guides (e.g., idlers, etc.) may guide the material about or around the filling tube.

At 804, the packaging device may use one or more edge sealers to form the edge seams to create an inner tube section and an outer tube section. In some embodiments, the edge sealers may adjoin the first and second material together in the seam, such as when a single edge sealer is used by the packaging device. Since an end of the inner bag and an end of the outer bag are already sealed (from a prior processing of an operation 814, discussed below), then the inner bag and outer bag may be filled with substances, such as air, product, and/or other gases or substances.

At 806, the packaging device may release product from the hopper into the inner bag through the filling tube. For example, a valve may be temporarily opened to allow a predetermined amount of the product to pass through the valve and fill at least a portion of the inner bag.

At 808, the packaging device may flush or remove oxygen from the inner bag. For example, when the product is a food product, oxygen may be removed to help preserve the food product for a longer duration while secured in the inner bag. The packaging device may cause a valve to temporarily open to cause nitrogen gas to enter the inner bag via the filling tube. The entry of the nitrogen gas, which is heavier than air, may cause the air (and oxygen) to be removed from the inner bag.

At 810, the packaging device may clamp the outer bag to the filling tube using the clamping arms to inhibit airflow from the outer bag. The clamp arms may remain in this position possibly until the operation 814, described below. The clamp arms may then disengage from the outer bag and from the filling tube to allow movement of the material relative to the filling tube.

At 812, packaging device may pressurize the outer bag, such as by adding air or gas to the outer bag. For example, a valve may open to cause air or gas to enter the outer bag, but refrain from entering the inner bag. In some embodiments, the outer bag may be pressurized up to five pounds per square inch (psi).

At 814, the packaging device may form an end seam of the package. For example, the sealing jaws may engage the material to create the seam. The seam may securely enclose the inner bag and the outer bag to secure the product in the inner bag and the air/gas in the outer bag. The seam may adjoin the first material and the second material. For example, the seam may be seam 302(1) and/or 302(3) as shown in FIG. 3A. When the packaging device is used to continually process material, the seam formed at the operation 814 may be a second seam for a finished package (e.g., the package 114 shown in FIG. 4, etc.) and concurrently a top seam for a next-processed package.

At 816, the packaging device may pull material away from the hopper. For example, the sealing jaws may pull the material, including the package having the inner bag and outer bag downward and away from the hopper to position additional material for forming of a next package.

At 818, the packaging device may detach the completed package (e.g., the package 114 shown in FIG. 4, etc.). For example, the packaging device may cause a cutting blade to cut across the seam formed at the operation 814 to detach the package from the material fed from the spools. In some embodiments, the operations 814, 816, and 818 may be performed at least partially during a continuous motion of the sealing jaws, which may also cause engagement of the cutting blade to the finish seam. As shown the processing may continue as a loop and return to the operation 802.

Conclusion

Although the subject matter has been described in language specific to structural features and/or methodological acts, it is to be understood that the subject matter defined in the appended claims is not necessarily limited to the specific features or acts described. Rather, the specific features and acts are disclosed as illustrative forms of implementing the claims.

What is claimed is:

1. A packaging device for creating a package for a product, the package including an inner bag surrounded by an outer bag that operates as an air cushion for protecting the product in the inner bag, the packaging device comprising:

a hopper for storing the product and for selectively releasing predetermined amounts of the product from the hopper;

a filling tube having a body, a first end coupled to the hopper and a second end opposite the first end for dispensing the product into the inner bag after releasing of the product from the hopper;

a first guide for positioning a first multi-layer material about the body of the filling tube, and in response to being processed by the packaging device, the first multi-layer material forming the inner bag for containing the product;

a second guide for positioning a second multi-layer material about the filling tube, and in response to being processed by the packaging device, the second multi-layer material forming the outer bag;

an edge sealer for creating a first seam for joining opposing sides of at least one of the first multi-layer material or the second multi-layer material for forming at least one tube of material with the first seam;

an air dispenser for injecting air and for creating air pressure within the outer bag without pressurizing the inner bag;

sealing jaws located proximate to the second end of the filling tube, the sealing jaws for sealing the inner bag and the outer bag together with a second seam for maintaining the air pressure within the outer bag and for securing the product within the inner bag; and a cutting blade for separating the package from the first and second multi-layer materials.

2. The packaging device as recited in claim 1, wherein the first multi-layer material is formed of layers including a first low-density polyethylene (LDPE) layer, a first adhesive layer, and a metallic layer, and wherein the second multi-layer material is formed of layers including a second LDPE layer, a second adhesive layer, and a polyethylene terephthalate (PET) layer.

3. The packaging device as recited in claim 1, further comprising a nitrogen gas dispenser for injecting nitrogen gas into the inner bag for removing oxygen from within the inner bag prior to sealing the inner bag with the sealing jaws.

4. The packaging device as recited in claim 1, wherein the second multi-layer material includes elasticity.

5. The packaging device as recited in claim 1, wherein a first width of the first multi-layer material is less than a second width of the second multi-layer material.

6. An apparatus comprising:

a filling tube for dispensing product into an inner bag;

a first guide for positioning a first multi-layer material about the filling tube, the first multi-layer material forming the inner bag for containing the product;

a second guide for positioning a second multi-layer material about the filling tube, the second multi-layer material forming an outer bag for containing the inner bag;

an edge sealer for creating a first seam for joining opposite sides of at least one of the first multi-layer material or the second multi-layer material for forming at least one tube of material including the first seam;

a dispenser for dispensing at least one of a gas or a cushioning substance into the outer bag without dispensing at least one of the gas or the cushioning substance into the inner bag; and sealing jaws for creating a second seam for adjoining the inner bag and the outer bag together for securing at least one of the gas or the cushioning substance within the outer bag and for securing the product within the inner bag.

7. The apparatus as recited in claim 6, further comprising a blade for decoupling the inner bag and outer bag from the first multi-layer material and the second multi-layer material.

8. The apparatus as recited in claim 6, wherein the outer bag and the inner bag collectively form a cushion package for protecting the product during transport.

9. The apparatus as recited in claim 6, wherein the edge sealer is a first edge sealer for joining a first side and a second side of the first multi-layer material, and further comprising a second edge sealer for joining a third side and a fourth side of the second multi-layer material.

10. The apparatus as recited in claim 6, further comprising clamps for temporarily inhibiting gas-flow from the outer bag while pressurizing the outer bag.

11. The apparatus as recited in claim 6, further comprising a nitrogen gas dispenser for dispensing nitrogen gas into the inner bag for removing oxygen from the inner bag prior to sealing the inner bag closed.

12. The apparatus as recited in claim 6, wherein the second multi-layer material is elastic.

13. The apparatus as recited in claim 6, wherein the first multi-layer material includes a metallic layer for preventing gas-flow into and out of the inner bag.

14. The apparatus as recited in claim 6, wherein the second multi-layer material includes a printable surface on a first side and an adhesive on a second side, the adhesive for bonding with the first multi-layer material when creating at least the second seam.

15. A method comprising dispensing multi-layered material to locate the multi-layered material about a product dispensing tube;

forming a first seam in the multi-layered material that secures the multi-layered material around a portion of the product dispensing tube;

adding product into the product dispensing tube for insertion into an inner bag formed by inner layers of the multi-layered material;

adding a gas between layers of the multi-layered material to pressurize an outer bag formed by outer layers of the multi-layered material;

creating a second seam across the multi-layered material to seal the inner bag and the outer bag together to maintain pressure within the outer bag and to secure the product within the inner bag; and cutting across the second seam to separate the inner bag and the outer bag as a package from the multi-layered material located about the product dispensing tube, the package including the inner bag surrounded by the outer bag that operates as a gas cushion to protect the product within the inner bag.

16. The method as recited in claim 15, further comprising removing oxygen from within the inner bag prior to creating the second seam across the multi-layered material.

17. The method as recited in claim 15, further comprising clamping the multi-layer material to the product dispensing tube prior to adding at least a portion of the gas, the clamping to inhibit gas-flow out of the outer bag prior to the sealing.

18. The method as recited in claim 15, wherein the forming the first seam includes forming a first seam in the multi-layered material that secures first layers of the multi-layered material around a portion of the product dispensing tube, and further comprising forming another seam in the multi-layered material that secures second layers of the multi-layered material around another portion of the product dispensing tube.

19. The method as recited in claim 15, wherein at least one of the inner layers includes a metallic layer for preventing gas-flow into and out of the inner bag or the outer layers include an elastic material.

20. The method as recited in claim 15, further comprising pulling the multi-layer material along the product dispensing tube using a sealing jaw that forms the second seam.

* * * * *